US006941955B2

(12) United States Patent
Yao

(10) Patent No.: US 6,941,955 B2
(45) Date of Patent: Sep. 13, 2005

(54) HAIR IRON DEVICE

(75) Inventor: Isoji Yao, Higashiosaka (JP)

(73) Assignee: Naomoto Industry Co., Ltd., Osaka (JP)

( * ) Notice: Subject to any disclaimer, the term of this patent is extended or adjusted under 35 U.S.C. 154(b) by 3 days.

(21) Appl. No.: 10/667,600

(22) Filed: Sep. 23, 2003

(65) Prior Publication Data

US 2005/0061352 A1 Mar. 24, 2005

(51) Int. Cl.[7] ..... A45D 1/00
(52) U.S. Cl. ..... 132/225; 219/222
(58) Field of Search ..... 132/223, 224, 132/225, 226, 227, 228, 229, 232, 234, 269, 271, 272, 116, 118, 120, 124, 139, 148; 34/97, 98, 100; 219/222, 225; 126/362, 1; D28/26, 29, 35, 37

(56) References Cited

U.S. PATENT DOCUMENTS 1,221,447 A * 4/1917 Henderson ..... 132/118
1,572,161 A * 2/1926 Russell ..... 132/118
1,605,540 A * 11/1926 Gibney ..... 132/127
1,694,672 A * 12/1928 Rogler ..... 132/225
1,738,916 A * 12/1929 Murray ..... 132/224
1,798,760 A * 3/1931 Rothman ..... 132/224
1,847,619 A * 3/1932 Mascolo ..... 604/23
2,103,676 A * 12/1937 Karasiewicz ..... 132/225
2,171,725 A * 9/1939 Hambrick, Jr. ..... 132/113
2,762,382 A * 9/1956 Morgan, Sr. ..... 132/148
2,880,299 A * 3/1959 Jones ..... 132/232
3,065,759 A * 11/1962 Lewis ..... 132/118
3,934,114 A * 1/1976 Godel et al. ..... 219/222
4,163,143 A * 7/1979 Federico et al. ..... 219/225
4,266,116 A * 5/1981 Bauer et al. ..... 392/324
4,739,151 A * 4/1988 Smal ..... 219/225
4,813,439 A * 3/1989 Morgan ..... 132/116
5,223,694 A * 6/1993 Tsuji et al. ..... 219/225
5,584,307 A * 12/1996 Bauer et al. ..... 132/113
5,781,691 A * 7/1998 Kwok ..... 392/405
5,913,315 A * 6/1999 Todd ..... 132/208
6,047,704 A * 4/2000 Giordano ..... 132/122
6,070,596 A * 6/2000 Altamore ..... 132/224
6,119,702 A * 9/2000 Habibi ..... 132/224
6,191,387 B1 * 2/2001 Smal ..... 219/225
6,325,072 B1 * 12/2001 Smetana ..... 132/228

FOREIGN PATENT DOCUMENTS

JP 2002-253329 9/2002

* cited by examiner

*Primary Examiner*—Eduardo C. Robert
*Assistant Examiner*—David Comstock
(74) *Attorney, Agent, or Firm*—Armstrong, Kratz, Quintos, Hanson, & Brooks, LLP.

(57) ABSTRACT

A hair iron device having a hair iron main body, which holds hair with a first iron and a second iron oscillating to open and close, in order to set the hair. Plural small protruding portions having a pyramid shape are disposed on corresponding faces, and mutually come close to each other when the first and second irons are moved toward each other, so as to mutually engage.

13 Claims, 8 Drawing Sheets

HAIR IRON DEVICE

BACKGROUND OF THE INVENTION

1. Field of the Invention

This invention relates to a hair iron device for business and household use.

2. Description of the Related Art

Generally, a hair iron has two irons which are mutually oscillatable (to hold hair). The inventor of the present invention has proposed a hair iron having two such irons to set the hair only with steam (refer to Japanese Provisional Publication No. 2002-253329).

However, corresponding faces, which mutually come close to each other in a closed state of the two irons, are formed as flat faces. And, the two irons tend to hold the hair with non-uniform thickness. Therefore, unevenness is generated in a heating state.

It is therefore an object of the present invention to provide a hair iron device with which hair can be held with approximately uniform thickness and heated uniformly. And, it is another object of the invention to provide a hair iron device with which the hair is heated efficiently and quickly to be beautifully set.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
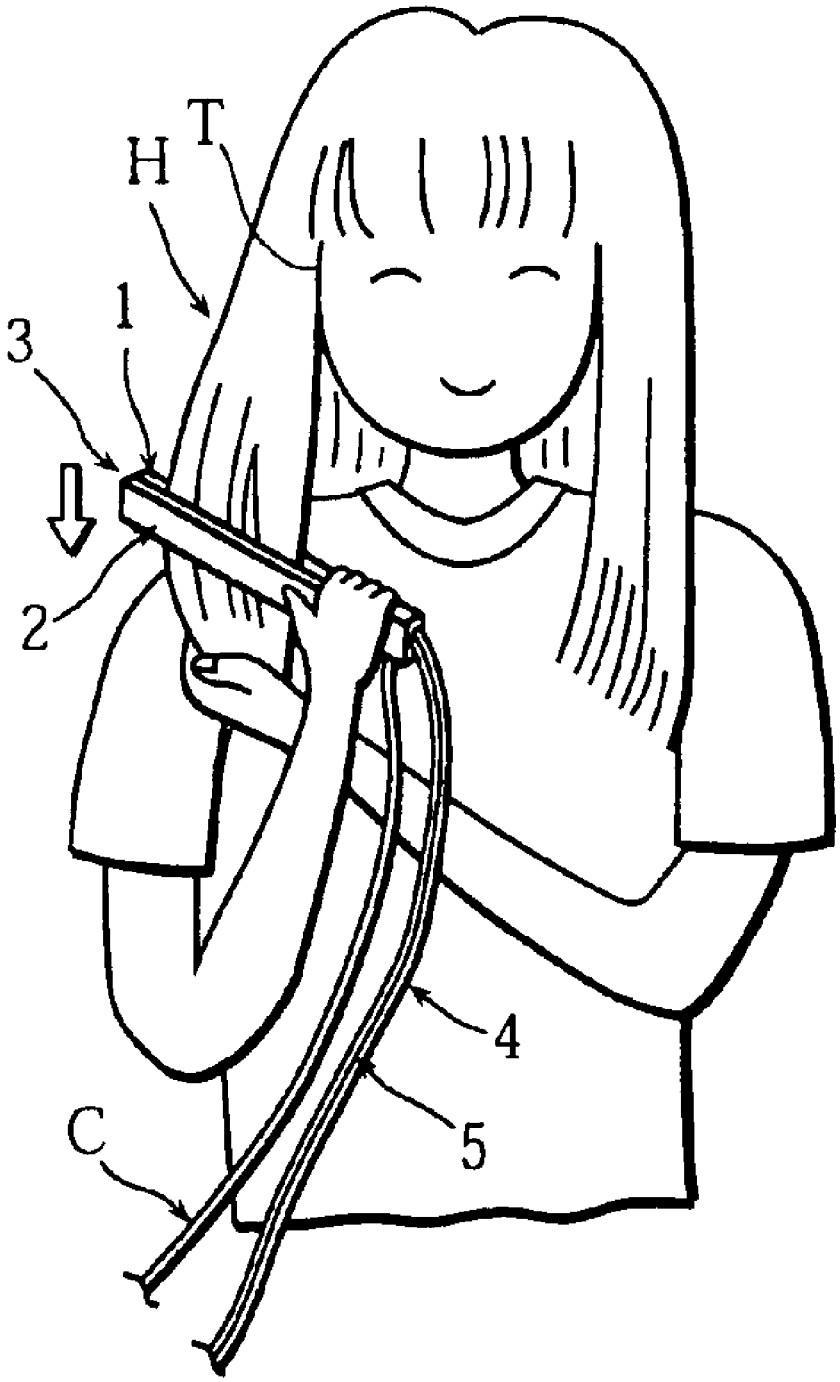
FIG. 1 is an explanatory view showing a used state of a first embodiment of the present invention.

FIG. 1 shows a used state of a first embodiment of a hair iron device relating to the present invention. This hair iron device heats hair H to set (arrange hair style). Especially, the hair iron device is used to make the hair H straight. The hair iron device has a hair iron main body 3 to set the hair H with a first iron 1 and a second iron 2, both of which are made of metal, oscillating to open and close for holding the hair H. The first iron 1 is positioned on scalp T side, and the second iron 2 is positioned on an outer side.

Figure 2:
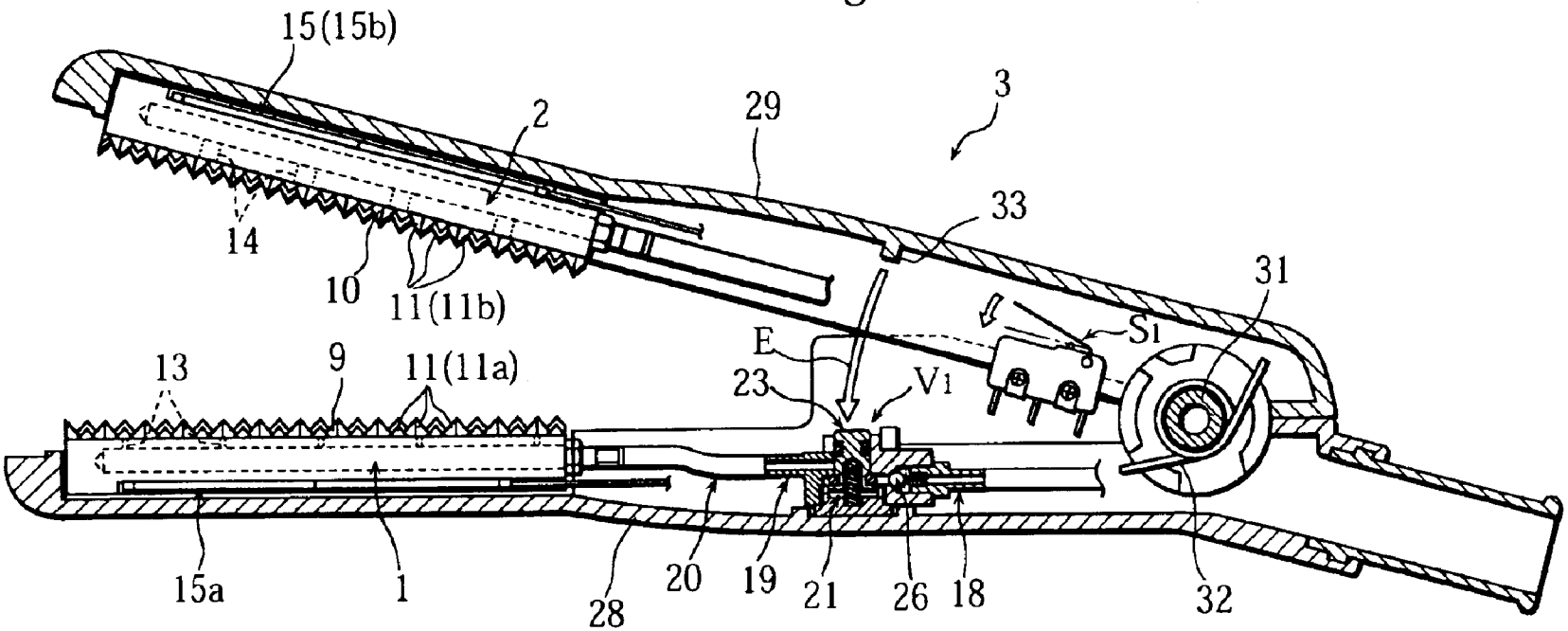
FIG. 2 is a front view with partial cross section showing a hair iron main body.
Figure 8:
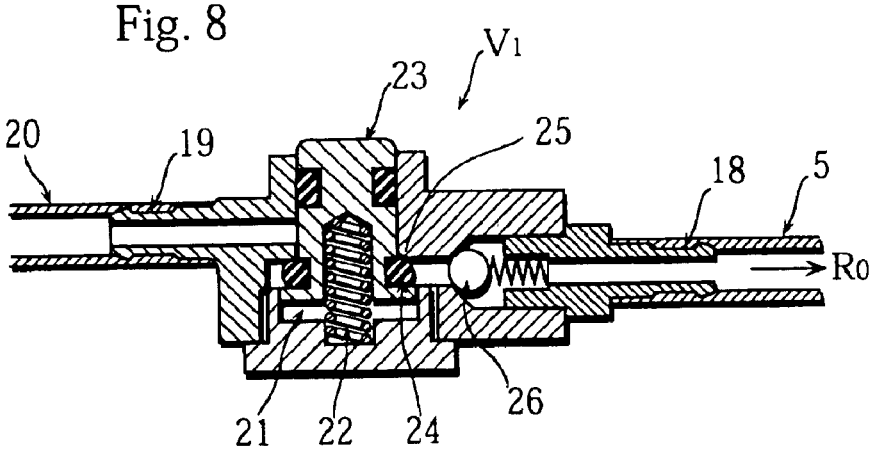
FIG. 8 is an enlarged cross-sectional front view of a principal portion.
Figure 9:
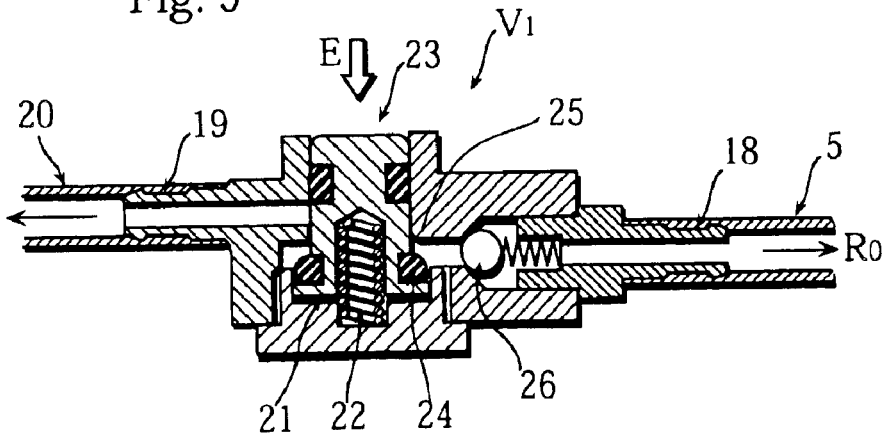
FIG. 9 is an enlarged cross-sectional front view of the principal portion.

As shown in FIGS. 2, 8, and 9, a steam valve $V_1$, becomes "closed" in an open state of the first and second irons 1 and 2 and becomes "open" in a closed state of the first and second irons 1 and 2, is attached to the hair iron main body 3. And, a suction switch $S_1$, switched off in the open state of the first and second irons 1 and 2 and switched on in the closed state of the first and second irons 1 and 2, is attached to the hair iron main body 3. The suction switch $S_1$ is, for example, composed of a micro switch.

Figure 3:
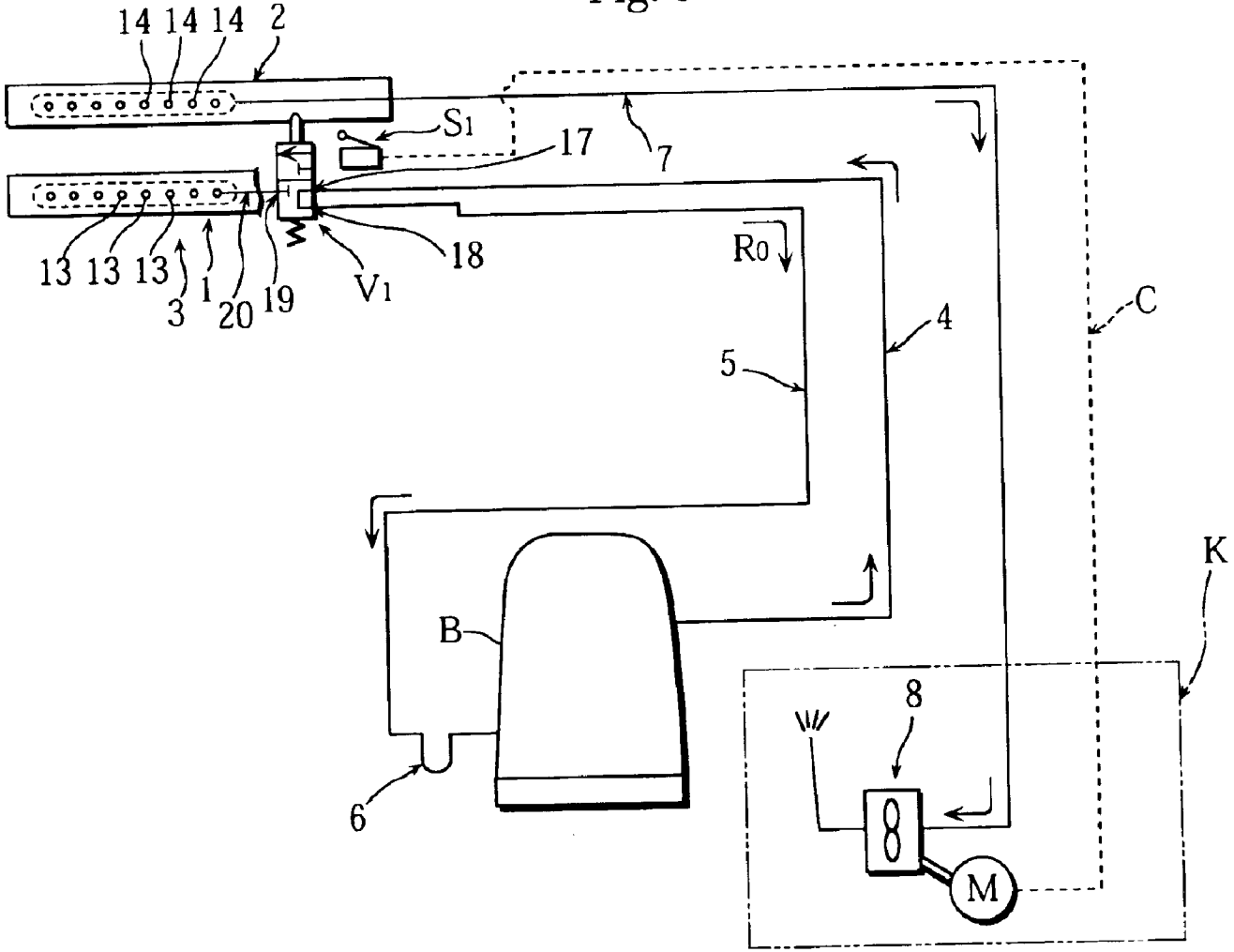
FIG. 3 is an explanatory view of construction.

As shown in FIG. 3, a boiler B (steam-generator) is connected to the steam valve $V_1$ with a steam-supplying tube 4 and a drain tube 5. And, a circulation, in which steam of the boiler B is supplied to the steam valve $V_1$ by the steam-supplying tube 4 and returned to the boiler B by the drain tube 5, is continued when the steam valve $V_1$ is in the "closed" state. Further, when the steam valve $V_1$ is in the "open" state, the steam of the boiler B is jetted out of the hair iron main body 3. The drain tube 5 always (namely, irrespective of the opened or the closed state of the steam valve $V_1$) returns drain (water) from the steam valve $V_1$ to the boiler B (makes return $R_0$). The drain tube 5 has a steam trap 6 near the boiler B. The drain also may be discharged from the steam trap 6.

A suction means K connected to the hair iron main body 3 with a suction tube 7 is composed as to be switched on and off by the suction switch $S_1$. Concretely, the suction means K has a suction fan 8 and a driving motor M for the suction fan 8 the suction fan 8 of the suction means K is connected to the second iron 2 of the hair iron main body 3 through the suction tube 7. And, the suction switch $S_1$ is connected to the driving motor M of the suction fan 8 by an electric connection C to switch on and off the driving motor M of the suction fan 8.

Figure 4:
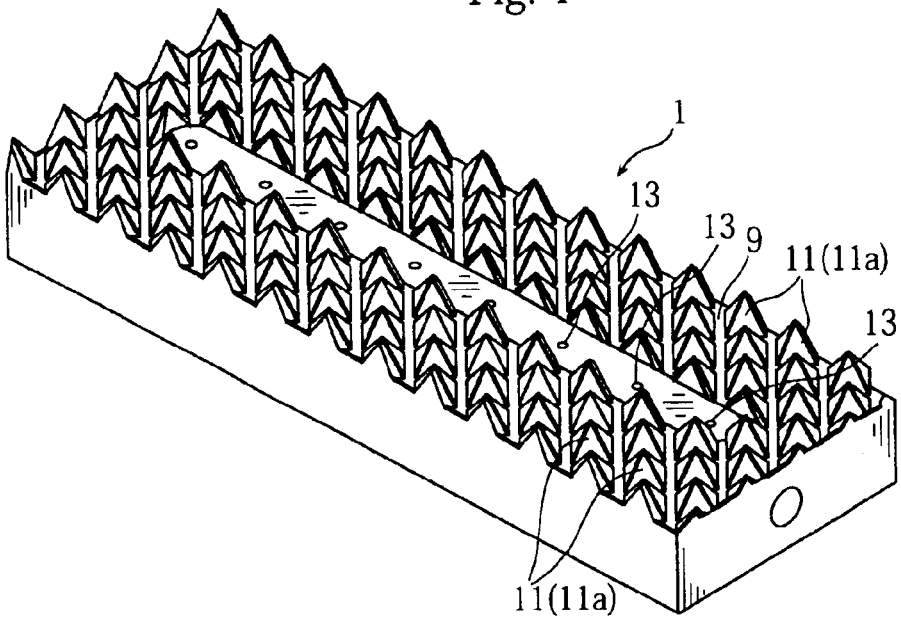
FIG. 4 is an explanatory perspective view showing a first iron.
Figure 5:
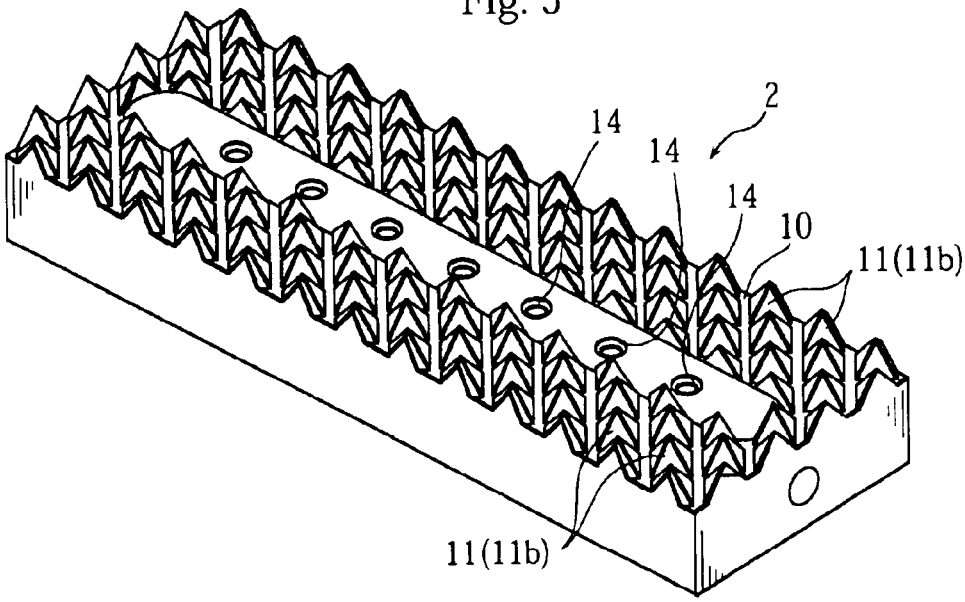
FIG. 5 is an explanatory perspective view showing a second iron.
Figure 6:
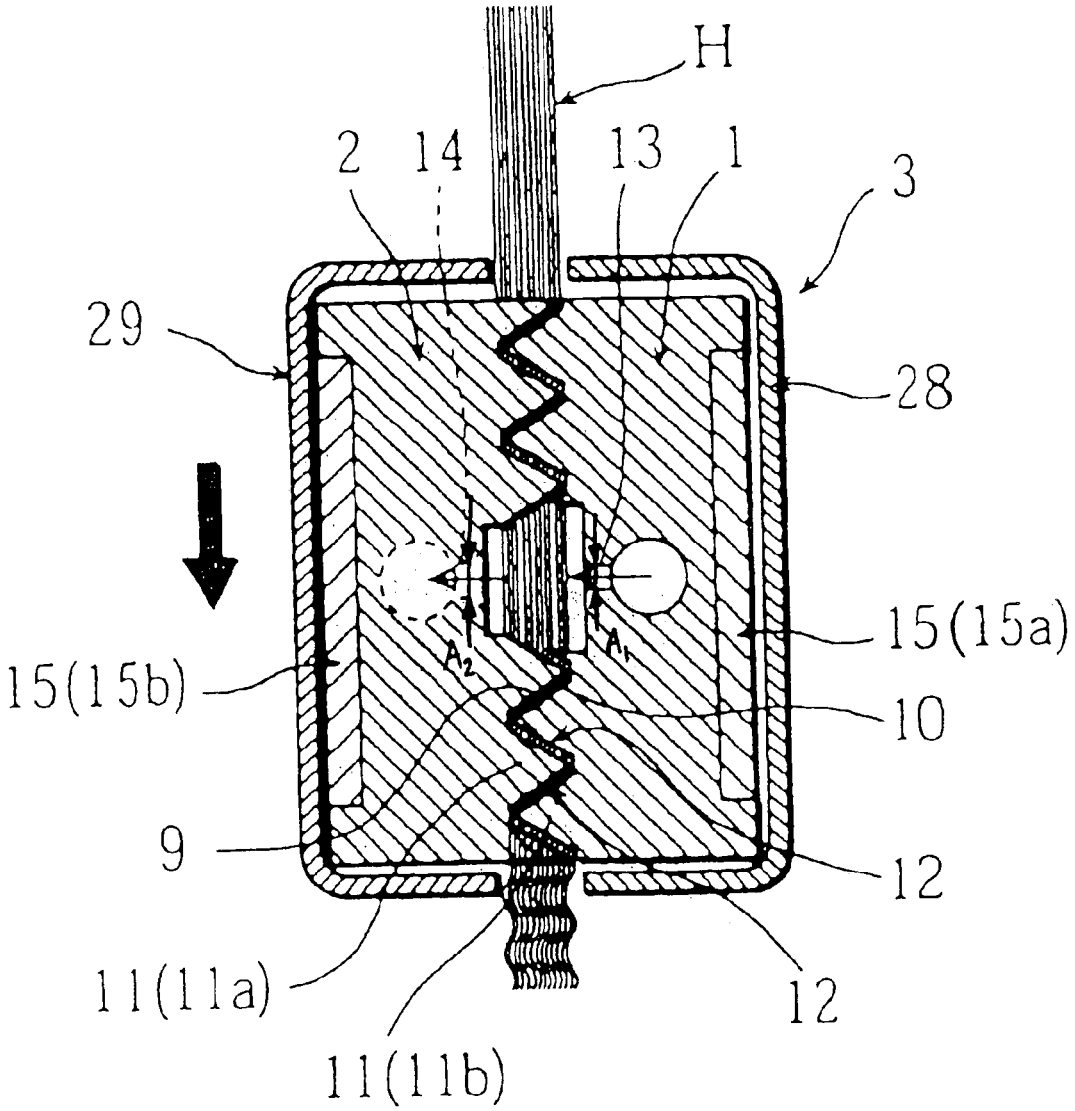
FIG. 6 is an enlarged cross-sectional side view of a principal portion also serving as an explanatory view of usage.

FIG. 4 shows the first iron 1 and FIG. 5 shows the second iron 2. As shown in FIGS. 4 through 6, plural small protruding portions 11 are disposed on corresponding faces 9 and 10 mutually come close when the first iron 1 and the second iron 2 are closed as to mutually engage. The small protruding portion 11 is, for example, formed into a regular pyramid. In the closed state of the first iron 1 and the second iron 2, a micro gap 12 is formed between the small protruding portions 11*a* on the first iron 1 and the small protruding portions 11*b* on the second iron 2. The hair H is held in the micro gap 12. The micro gap 12 is formed by mutual contact of parts (not shown in Figures) of the corresponding faces 9 and 10.

The hair iron main body 3 is composed as to jet out the steam from the first iron 1 and suck the jetted steam with the second iron 2. Concretely, steam-jetting holes 13 are disposed between the plural small protruding portions 11*a* on the corresponding face 9 of the first iron 1, and steam suction holes 14 are disposed between the plural small protruding portions 11*b* on the corresponding face 10 of the second iron 2. In other words, the steam-jetting holes 13 are opening on an approximately central portion in width direction of the corresponding face 9 of the first iron 1 with a predetermined pitch, and formed as to be surrounded by the plural small protruding portions 11*a*. And, the steam suction holes 14 are opening on an approximately central portion in width direction of the corresponding face 10 of the second iron 2 with a predetermined pitch, and formed as to be surrounded by the plural small protruding portions 11*b*. The steam-jetting holes 13 are connected to a steam-supplying tube 20 (described later). The steam suction holes 14 are connected to the suction tube 7 (refer to FIG. 3).

Figure 11:
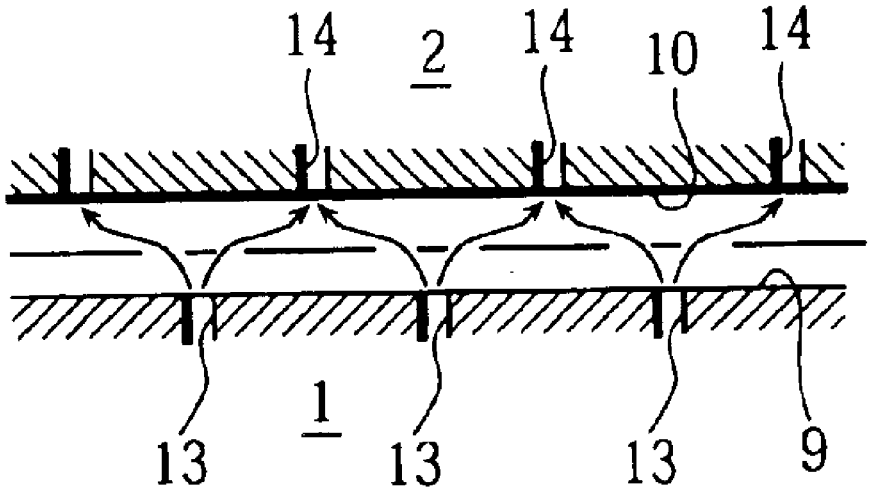
FIG. 11 is an enlarged cross-sectional view of a principal portion to explain a function.

As observed in FIG. 11, and, FIGS. 2, 4, and 5, positions of the steam-jetting holes 13 are disposed not to correspond to that of the steam suction holes 14 when observed in a direction at right angles with the corresponding faces 9 and 10 in the closed state in which the corresponding face 9 of the first iron 1 and the corresponding face 10 of the second iron 2 mutually come close. In FIG. 11, longitudinal positions of the steam-jetting holes 13 and the steam suction holes 14, disposed along a central line in the width direction with the predetermined pitch, are dislocated as the steam jetted out of one of the steam-jetting holes 13 flows into neighboring two steam suction holes 14 as shown in FIG. 11. With this construction, the steam contacts the hair held by the corresponding faces 9 and 10 for relatively long time to uniformly contact the entire hair (local contact is prevented).

As shown in FIG. 6, cross-sectional area $A_1$ of the steam-jetting hole 13 is set to be smaller than cross-sectional area $A_2$ of the steam suction hole 14. The steam jetted out of the steam-jetting hole 13 can be certainly sucked into the steam suction hole 14. In the hair iron main body 3, an electric heater 15*a* is embedded in the first iron 1 and an electric heater 15*b* is embedded in the second iron 2. The electric heaters 15*a* and 15*b* are controlled by a thermistor not shown in Figures. The first and second irons 1 and 2 are warmed by the electric heaters 15*a* and 15*b* to be always at an appropriate temperature. A mark 28 represents a first iron holder to hold the first iron 1, and a mark 29 represents a second iron holder to hold the second iron 2. And, the first iron 1 and the second iron 2 are connected as to be oscillatable with a connecting shaft 31 as shown in FIG. 2, and the first iron 1 and the second iron 2 are elastically pushed by a pinch spring 32 as to return to the open state.

Figure 7:
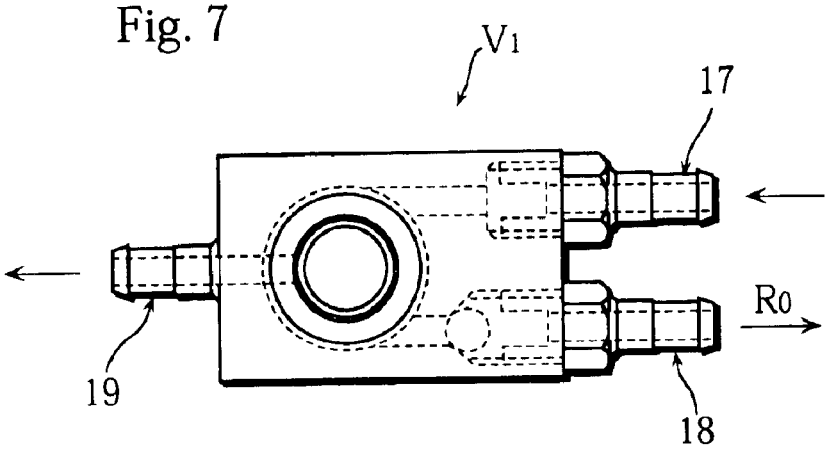
FIG. 7 is an enlarged top view of a principal portion.

FIG. 7 shows the steam valve $V_1$. A mark 17 represents a steam inlet connected to the steam-supplying tube 4 (refer to FIG. 3). A mark 18 represents a steam outlet connected to the drain tube 5. And a mark 19 represents a steam-supplying outlet connected to a steam-supplying tube 20 to supply the steam to the first iron 1.

FIG. 8 shows the "closed" state of the steam valve $V_1$. In this state, the steam supplied through the steam inlet 17 (refer to FIG. 7) is flowing through a steam chamber 21 and sent out of the steam outlet 18. And, the steam is not discharged through the steam-supplying outlet 19.

A mark 22 represents a spring to elastically push a spindle (valve body) 23 upward, a mark 24 represents an O-ring, a mark 25 represents a valve seat, and a mark 26 represents a check valve. In the "closed" state of the steam valve $V_1$, the spindle 23 is on an upper position, and the connection between the steam inlet 17 (refer to FIG. 7) and the steam-supplying outlet 19 is cut by the tightly fitting O-ring 24 and the valve seat 25. In this state, the check valve 26 is opened by pressure of the steam flowing into the steam valve $V_1$ through the steam inlet 17 to connect the steam-supplying tube 4 (refer to FIG. 3) to the drain tube 5. Therefore, the steam valve $V_1$ is always warmed by the circulating steam, and water drops are prevented thereby from being sent toward the first iron 1 when the spindle 23 is pushed as shown with an arrow E in FIG. 9 and the steam valve $V_1$ is suddenly opened.

FIG. 9 shows the "open" state of the steam valve $V_1$. In this state, the steam supplied through the steam inlet 17 (refer to FIG. 7) is sent to the steam-supplying outlet 19. That is to say, the steam is sent to the steam-supplying tube 20 to supply the steam to the first iron 1 (refer to FIG. 7).

Concretely, in FIG. 2, as the second iron 2 and the first iron 1 are closed by hand holding the hair iron in the direction of an arrow E, a protruding piece 33 pushes the spindle 23 of the steam valve $V_1$ to make the "open" state of the valve $V_1$. In the "open" state of the valve $V_1$, the spindle 23 is on a lower position, and the steam-supplying tube 4 and the steam-supplying tube 20 are connected by the O-ring 24 parted from the valve seat 25.

Figure 10:
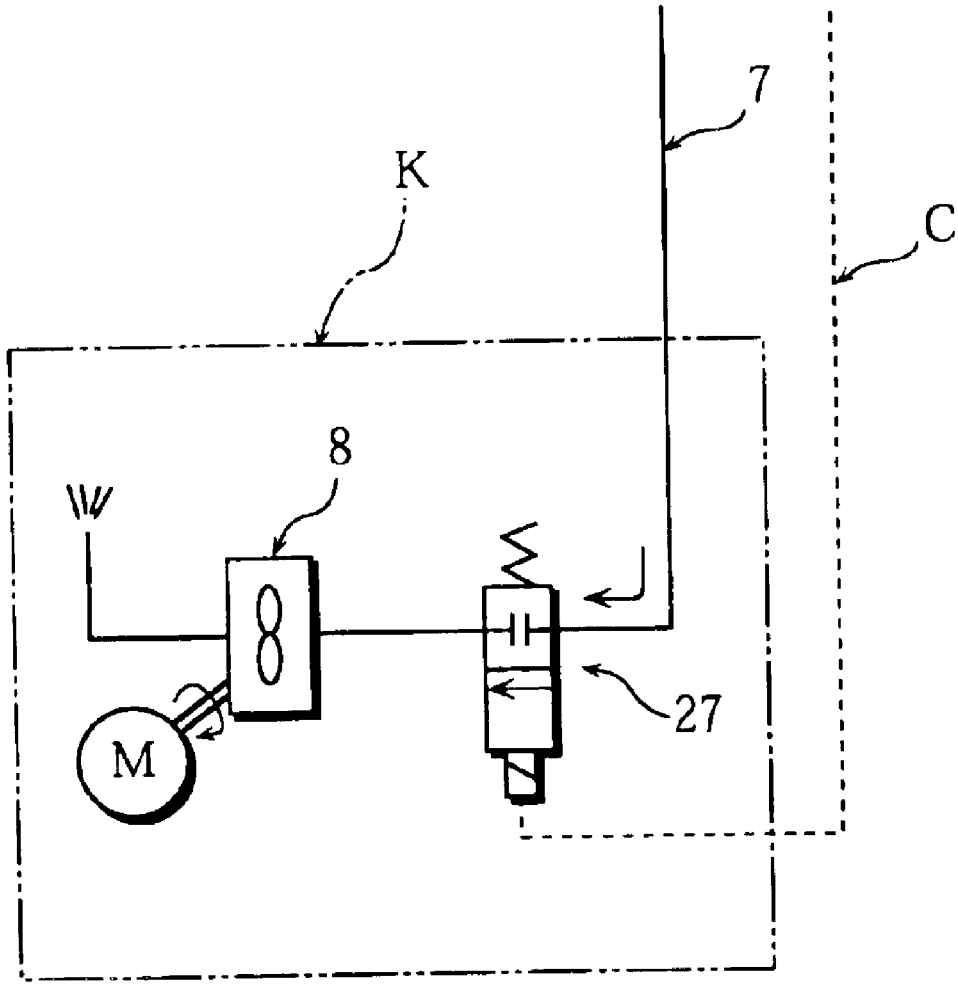
FIG. 10 is an explanatory view of construction showing a second embodiment.

FIG. 10 shows a second embodiment of the suction means K, the suction tube 7 makes a connection C of the suction fan 8 and the second iron 2 of the hair iron main body 3 (refer to FIG. 3) through an electromagnetic valve 27. The suction switch $S_1$ switches on and off the electromagnetic valve 27. The suction fan 8 is always driven by the driving motor M for the suction fan 8.

Next, function of the hair iron device of the present invention is described.

In the open state of the first iron 1 and the second iron 2, the steam valve $V_1$ is in the "closed" state, the steam from the boiler B flows through the steam-supplying tube 4, the steam valve $V_1$, the drain tube 5, and the steam trap 6 serially, and returns to the boiler B (return $R_0$). In this state, water drops in the steam valve $V_1$ are continuously discharged, and the steam valve $V_1$ is always warmed. And, the suction switch $S_1$ is switched off, and suction is not conducted by the second iron 2.

When the first iron 1 and the second iron 2 are closed by hand, the steam valve $V_1$ becomes the "open" state, the suction switch $S_1$ is switched on, the steam from the boiler B, flowing through the steam-supplying tube 4, the steam valve $V_1$, the steam-supplying tube 20, the first iron 1, the second iron 2, the suction tube 7, and the suction fan 8 serially, is discharged to the atmosphere. The hair H is held by the first iron 1 and the second iron 2, and blown with the steam and heated to be made straight.

In the present invention, subject to modification, the small protruding portion 11 may be pyramidal such as a hexagonal pyramid, an octagonal pyramid, etc. And, the hair iron may be freely converted to an all-steam type (the heater is omitted) as long as the corresponding faces 9 and 10 have the plural small protruding portions 11. And, in FIG. 3, the steam trap 6 and the boiler B may not be connected as to discharge the steam to the atmosphere. And, various arrangements to dislocate the positions of the steam-jetting holes 13 and the steam suction holes 14 may be used such as that the steam-jetting holes 13 are disposed in a single row and the steam suction holes 14 are disposed in two rows.

As described above, the hair H can be held with an approximately uniform thickness by the first iron 1 and the second iron 2 and uniformly heated with the present invention, having the hair iron main body 3 to hold the hair H with the first iron 1 and the second iron 2 oscillatable to open and close to set the hair H, and plural small protruding portions 11 disposed on corresponding faces 9 and 10 which mutually come close in the closed state of the first iron 1 and the second iron 2 as to mutually engage to hold the hair. That is to say, when the hair H is held, the hair H is divided by the small protruding portions 11 of the corresponding faces 9 and 10 into appropriate amount. The hair H is layered little to be uniformly heated and steamed. And, heat efficiency to the hair H is improved by the small protruding portions 11 increasing contact of the hair H with the first iron 1 and the second iron 2. Further, appropriate tension is obtained by the small protruding portions 11 holding the hair H, the first iron 1 and the second iron 2 do not strongly hold the hair, and labor of the user of the hair iron device (a beautician or a general user) can be alleviated thereby.

The hair H is divided smoothly into appropriate amount for the pyramidal small protruding portions 11.

The hair H is divided smoothly into appropriate amount for the small protruding portions 11 of regular pyramid. The first iron 1 and the second iron 2 are economically made in comparison with a case that the small protruding portion 11 is a hexagonal or octagonal pyramid.

The first iron 1 and the second iron 2 are always warmed to be appropriate temperature and the hair H is certainly set with the hair iron device having the hair iron main body 3 to hold the hair H with the first iron 1 and the second iron 2 to set the hair H, and a construction in which the hair iron main body 3 has electric heaters 15 each of which is embedded in the first iron 1 and the second iron 2 respectively, and steam is jetted out of the first iron 1 and sucked by the second iron 2. And, safety is improved because the steam does not leak toward outside.

When the hair H is held, the hair H is divided by the small protruding portions 11 of the corresponding faces 9 and 10 into appropriate amount, and heat efficiency to the hair H is improved by the small protruding portions 11 increasing contact of the hair H with the first iron 1 and the second iron 2 because the hair iron device has the hair iron main body 3 to hold the hair H with the first iron 1 and the second iron 2 to set the hair H, and a construction in which plural small protruding portions 11 are disposed on corresponding faces 9 and 10 which mutually come close in the closed state of the first iron 1 and the second iron 2 to hold the hair H as to mutually engage, the steam-jetting holes 13 are disposed on the corresponding face 9 of the first iron 1, the steam suction holes 14 are disposed on the corresponding face 10 of the second iron 2, and the electric heater 15 is embedded in each of the first iron 1 and the second iron 2. And, the first iron 1 and the second iron 2 are always warmed to be appropriate temperature, the hair H is certainly set, and safety is improved because the steam does not leak toward outside.

As shown in FIG. 11, the steam jetted out of the steam-jetting hole 13 (not immediately sucked by the steam suction hole 14) flows through a relatively long flowing passage to have enough contact with the hair H and uniformly heat the hair H to uniformly and efficiently set because the steam-jetting hole 13 is positionally dislocated from the steam suction hole 14 when observed in a direction at right angles with the corresponding faces 9 and 10 in the closed state in which the corresponding faces 9 and 10 mutually come close.

The steam is jetted in a direction parting from the scalp T because the first iron 1 is positioned on the scalp T side and the second iron 2 is positioned on an outer side in use, burning on the scalp T by the steam is prevented for safety improvement.

The steam is jetted and stopped only by open-close movement of the first iron 1 and the second iron 2 without special operation (such as switching on and off of another switch) to reduce labor of the user to the minimum because the steam valve $V_1$, which becomes "closed" in the open state of the first iron 1 and the second iron 2 and becomes "open" in the closed state of the first iron 1 and the second iron 2, is attached to the hair iron main body 3.

The steam is certainly sucked only when vacuum is necessary because the suction switch $S_1$, which is switched off in the open state of the first iron 1 and the second iron 2 and switched on in the closed state of the first iron 1 and the second iron 2, is attached to the hair iron main body 3, and a suction means K connected to the hair iron main body 3 through the suction tube 7 is switched on and off by the suction switch $S_1$.

The steam is jetted and stopped only by open-close movement of the first iron 1 and the second iron 2 without special operation (such as switching on and off of another switch) to reduce labor of the user to the minimum, and water drops are prevented to be mixed with the steam jetted out of the first iron 1 (to be sent out of the first iron 1) because the steam valve $V_1$, which becomes "closed" in the open state of the first iron 1 and the second iron 2 and becomes "open" in the closed state of the first iron 1 and the second iron 2, is attached to the hair iron main body 3, and the drain tube 5 to send drain from the steam valve $V_1$ to the steam trap 6 is provided.

The steam flow can be switched by open-close movement of the first iron 1 and the second iron 2 for great convenience because the steam valve $V_1$, which becomes "closed" in the open state of the first iron 1 and the second iron 2 and becomes "open" in the closed state of the first iron 1 and the second iron 2, is attached to the hair iron main body 3, the drain tube 5 to return drain from the steam valve $V_1$ to the boiler B is provided, a circulation, in which the steam from the boiler B is supplied to the steam valve $V_1$ through the steam-supplying tube 4 connecting the boiler B to the steam valve $V_1$ and returned to the boiler B through the drain tube 5, is always conducted in the "closed" state of the steam valve $V_1$, and the steam of the boiler B is jetted out of the hair iron main body 3 in the "open" state of the steam valve $V_1$. Water drops are prevented from jetting out of the first iron 1. Vapor is prevented from condensation by rapid cooling and defection such as jetting water drops out of the steam-jetting hole 13 on the first iron 1 is prevented because the steam is always flowing through the steam valve $V_1$.

While preferred embodiments of the present invention have been described in this specification, it is to be understood that the invention is illustrative and not restrictive, because various changes are possible within the spirit and indispensable features.

What is claimed is:

1. A hair iron device, comprising:

a hair iron main body to hold hair with a first iron and a second iron oscillatable to open and close to set the hair, and plural small protruding portions disposed on corresponding faces of the first and second irons which mutually come close to each other and engage each other in a closed state of the first iron and the second iron to hold the hair, wherein the small protruding portions on the face of the first iron are arranged in a plurality of rows surrounding and spaced apart from a first central portion of the face of the first iron, the first central portion forming a plurality of steam jetting holes having a first cross-sectional area, and the small protruding portions on the face of the second iron are arranged in a plurality of rows surrounding and spaced apart from a second central portion of the face of the second iron, the second central portion forming a plurality of steam suction holes having a second cross-sectional area, the first cross-sectional area being smaller than the second cross-sectional area.

2. The hair iron device as set forth in claim 1, wherein the small protruding portion is pyramidal.

3. The hair iron device as set forth in claim 1, wherein the small protruding portion is a regular pyramid.

4. A hair iron device having a hair iron main body to hold hair with a first iron having a face with protruding portions and a second iron having a face with protruding portions to set the hair comprising a construction in which the hair iron main body has electric heaters each of which is embedded in the first iron and the second iron respectively, and steam is jetted out of the first iron and sucked by the second iron, wherein the protruding portions on the face of the first iron are arranged in a plurality of rows surrounding and spaced apart from a first central portion of the face of the first iron, the first central portion forming a plurality of steam jetting holes having a first cross-sectional area, and the protruding portions on the face of the second iron are arranged in a plurality of rows surrounding and spaced apart from a second central portion of the face of the second iron, the second central portion forming a plurality of steam suction holes having a second cross-sectional area, the first cross-sectional area being smaller than the second cross-sectional area.

5. A hair iron device having a hair iron main body to hold hair with a first iron and a second iron to set the hair comprising a construction in which plural small protruding portions are disposed on corresponding faces which mutually come close in a closed state of the first iron and the second iron to hold the hair and to mutually engage, steam-jetting holes are disposed on the corresponding face of the first iron, steam suction holes are disposed on the corresponding face of the second iron, and an electric heater is embedded in each of the first iron and the second iron at a position spaced apart from the small protruding portions, wherein the small protruding portions on the face of the first iron are arranged in a plurality of rows surrounding and spaced apart from a first central portion of the face of the first iron, the first central portion forming the steam-jetting holes having a first cross-sectional area, and the small protruding portions on the face of the second iron are arranged in a plurality of rows surrounding and spaced apart from a second central portion of the face of the second iron, the second central portion forming the steam suction holes having a second cross-sectional area, the first cross-sectional area being smaller than the second cross-sectional area.

6. The hair iron device as set forth in claim 5, wherein the steam-jetting hole is positionally dislocated from the steam suction hole when observed in a direction at right angles with the corresponding faces in the closed state in which the corresponding faces mutually come close.

7. The hair iron device as set forth in claim 4, 5, or 6 wherein a steam valve, which becomes closed in an open state of the first iron and the second iron and becomes open in the closed state of the first iron and the second iron, is attached to the hair iron main body.

8. The hair iron device as set forth in claim 4, 5, or 6, wherein a suction switch, which is switched off in an open state of the first iron and the second iron and switched on in the closed state of the first iron and the second iron, is attached to the hair iron main body, and a suction means connected to the hair iron main body through a suction tube is switched on and off by the suction switch.

9. The hair iron device as set forth in claim 8, wherein a steam valve, which becomes closed in the open state of the first iron and the second iron and becomes open in the closed state of the first iron and the second iron, is attached to the hair iron main body, and a drain tube to send drain from the steam valve to a steam trap is provided.

10. The hair iron device as set forth in claim 8, wherein a steam valve, which becomes closed in the open state of the first iron and the second iron and becomes open in the closed state of the first iron and the second iron, is attached to the hair iron main body, a drain tube to return drain from the steam valve to a boiler is provided, a circulation, in which the steam from the boiler is supplied to the steam valve through a steam-supplying tube connecting the boiler to the steam valve and returned to the boiler through the drain tube, is always conducted when the steam valve is closed, and the steam of the boiler is jetted out of the hair iron main body when the steam valve is open.

11. The hair iron device as set forth in claim 4 or claim 5, wherein the first iron is positioned on a scalp side and the second iron is positioned on an outer side in use.

12. The hair iron device as set forth in claim 5, wherein the small protruding portion is pyramidal.

13. The hair iron device as set for in claim 5, wherein the small protruding portion is a regular pyramid.

* * * * *